United States Patent [19]

Breese

[11] Patent Number: 4,934,334

[45] Date of Patent: Jun. 19, 1990

[54] SCREEN FOR PROTECTING RECREATIONAL VEHICLE HEATING SYSTEM

[76] Inventor: Ralph L. Breese, 5504 Pioneer Circle, Norman, Okla. 73072

[21] Appl. No.: 293,376

[22] Filed: Jan. 4, 1989

[51] Int. Cl.[5] ..... F23L 1/00

[52] U.S. Cl. ..... 126/85 B

[58] Field of Search ..... 126/85 B; 98/62, 66.1, 98/64

[56] References Cited

U.S. PATENT DOCUMENTS

| | | | |
|---|---|---|---|
| 2,966,838 | 1/1961 | Thompson et al. | 126/85 B |
| 3,394,696 | 7/1968 | Cooper | 126/85 B X |
| 3,426,742 | 2/1969 | Passarello | 126/85 B |
| 3,509,865 | 5/1970 | Robinson | 126/85 B |
| 3,662,735 | 5/1972 | Jackson | 126/85 B |
| 3,765,823 | 10/1973 | Kawabata et al. | 126/85 B X |
| 4,108,144 | 8/1978 | Wilhoite | 126/85 B X |

FOREIGN PATENT DOCUMENTS

| | | | |
|---|---|---|---|
| 1070805 | 12/1959 | German Democratic Rep. | 126/85 B |
| 348529 | 10/1960 | Switzerland | 126/85 B |
| 676829 | 8/1952 | United Kingdom | 126/85 B |
| 930248 | 7/1963 | United Kingdom | 126/85 B |

*Primary Examiner*—Harold Joyce

*Attorney, Agent, or Firm*—Dunlap, Codding, Peterson & Lee

[57] ABSTRACT

A screen for covering inlet and/or outlet ducts in a heating system in a recreational vehicle for substantially preventing insects and the like from entering the heating system.

7 Claims, 3 Drawing Sheets

SCREEN FOR PROTECTING RECREATIONAL VEHICLE HEATING SYSTEM

FIELD OF THE INVENTION

The present invention comprises at least one screen disposed over one end of an inlet or outlet duct or both portion of a heating system in a recreational vehicle for substantially preventing insects and the like such as wasps from entering the heating system via the inlet or outlet duct.

DESCRIPTION OF THE PREFERRED EMBODIMENTS

Figure 1:
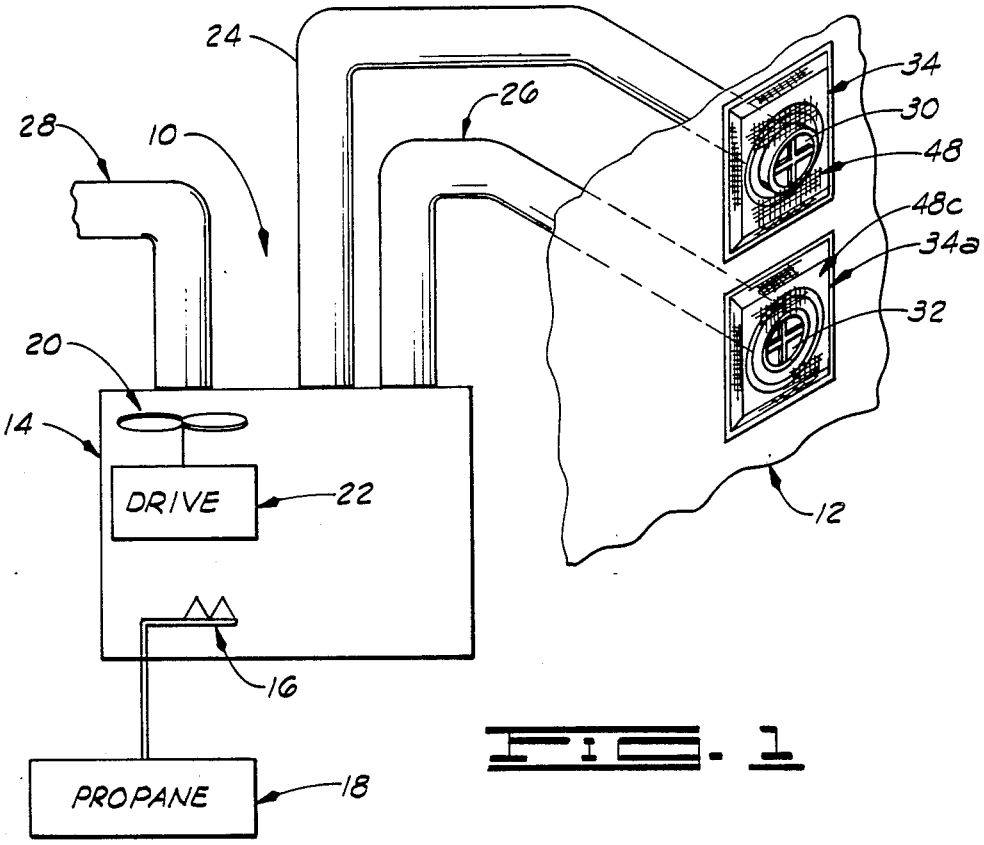
FIG. 1 is a diagrammatic, schematic view showing a portion of one side of a typical recreational vehicle and showing a portion of the heating system of the recreational vehicle and showing two screens constructed in accordance with the present invention connected to the inlet and outlet ducts.

Referring to FIG. 1, diagrammatically shown therein is a portion of a heating system 10 of a typical recreational vehicle, only one side 12 of the recreational vehicle is shown in FIG. 1. The heating system 10 comprises a heating unit 14 containing burners 16 which typically are connected to a propane source of gas 18. The heating unit 14 also includes a fan 20 operatively connected to a fan drive 22.

One end of an inlet duct 24 is connected to the heating unit 14 and the opposite end of the inlet duct 24 is connected to the side 12 of the recreational vehicle. The inlet duct 24 includes an opening which extends therethrough and intersects the opposite ends thereof. More particularly, the inlet duct 24 extends through the side 12 of the recreational vehicle so that the end of the inlet duct 24 is exposed to the exterior of the recreational vehicle and so that air from the exterior of the recreational vehicle can pass through the inlet duct 24 and into the heating unit 14.

The heating system 10 also includes an outlet duct 26. One end of an outlet duct 26 is connected to the heating unit 14 in the opposite end of the outlet duct 26 is connected to the side 12 of the recreational vehicle. The outlet duct 26 includes an opening which extends therethrough and intersects the opposite ends thereof. More particularly, the outlet duct 26 extends through the side 12 of the recreational vehicle so that the end of the outlet duct 26 is exposed to the exterior of the recreational vehicle for passing air from the heating unit 14 to the exterior of the recreational vehicle.

The heating system 10 also includes a heated air transfer duct 28 having an opening extending therethrough. The heated air transfer duct 28 is connected to the heating unit 14 so that the opening in the heated air transfer duct 28 is in communication with a portion of the heating unit 14.

In operation, air from the exterior of the recreational vehicle is transferred through the opening in the inlet duct 24 into a portion of the heating unit 14 where the air is heated by the flame from the burners 16. The heated air is transferred through the heated air transfer duct 28 via the fan 20 for heating selected portions of the recreational vehicle. Some of the air within the heating unit 14 is transferred from the heating unit 14 through the opening in the outlet duct 26 outwardly to the exterior of the recreational vehicle.

Recreational vehicles of the type referred to in here are common and well known such as a recreational vehicle manufactured by, Fleetwood Model and Travel Villa, for example. Recreational vehicles of this type typically include heating systems with heating units and ducts which operate exactly like the heating system 10, the heating unit 14, and the ducts 24, 26 and 28 described before, such as the heating system commercially available from Suburban Company or Duo-Therm made by Dometic Company, for example.

Commonly the inlet and outlet ducts of such prior heating systems have included a cross-bar secured over the inlet and the outlet ducts, such as the cross-bars 30 and 32 secured over the inlet and the outlet ducts 24 and 26, respectively, as shown in FIG. 1. Also, in the past, it has been common for insects (wasps, mud daubers and spiders and the like) to enter the inlet and the outlet ducts 24 and 26 through the openings provided by the cross-bars 30 and 32 and such insects commonly have entered into the interior of the heating unit 14. Insects, such as wasps and mud daubers, commonly have built nest within the interior of the heating unit 14 thereby causing a disturbance in the desired air flow within the heating unit 14. Also, wasps and mud daubers commonly have become deposited on the blades of the fan 22 causing an imbalance in the fan 22 resulting in failure of some portion of the fan 20 or fan drive 22 requiring repair or replacement. In such prior systems, the owner of the recreational vehicle typically has had to pay a dealer to clean out the interior of the heating unit and/or buy a new fan motor which was burned out as a result of insects being deposited on the fan 20. The present invention provides a convenient and economical solution to such prior problems.

Shown in FIGS. 2, 3, 4, 5 and 6, is a screen 34 which is constructed in accordance with the present invention. The screen 34 includes a base 36 defining an outer peripheral surface 38. The outer peripheral surface 38 more particularly defines a four sided or rectangularly shaped base 36. The base 36 has a forward side 40 (shown in FIGS. 2 and 3), a rearward side 42 (shown in FIGS. 2 and 4), a first end 44 (shown in FIGS. 2 and 5), and a second end 46 (shown in FIGS. 2 and 6).

The screen 34 extends a distance upwardly or outwardly from the base 36 or the outer peripheral surface 38 terminating with an outward end 48 thereby forming a side screen surface 50 which extends generally about the outer peripheral surface 38 and generally about the base 36. The outward end 48 is generally flat and lies in a plane about parallel with the plan of the base 36.

The screen 34 includes a plurality of screen openings 52. The screen openings 52 are formed through the screen 34 and the screen openings 52 are sized and spaced over the surface area of the screen 34 so that a sufficient percentage of the screen 34 remains opened via the screen openings 52 to permit sufficient air flow through the screen openings 52 while the screen openings 52 are sufficiently small to block and prevent a substantial portion of insects from passing through the screen openings 52 in a manner and for reasons to be made more apparent below.

In one preferred form, the screen openings 52 are sized and positioned so that the entire surface area of the screen 34 is less than about forty percent closed. The screen openings 52 are square with each of the sides being less than or equal to about 3/16 inch and preferably less than or equal to about 1/8 inch or an equivalent circle.

In practice, the screen 34 is positioned over the opening in the inlet duct 24 generally adjacent the side 12 of the recreational vehicle, as shown in FIG. 1. In this position, the base 36 of the screen 34 is disposed generally adjacent the side 12 of the recreational vehicle and the screen 34 encompasses substantially the entire area of the opening in the inlet duct 24. In one form, the screen 34 can be secured over the opening in the inlet duct 24 by connecting the screen to the cross-bar 30 via a fastener 53 or, in another form, the base 36 may be secured to the side 12 of the recreational vehicle. In this position, the screen 34 extends a distance outwardly from the side 12 of the recreational vehicle since the screen 34 extends outwardly from the base 36 to form the side screen surface 50. The screen openings 52 are sized so that sufficient air may pass through the screen 34 and into the opening in the inlet duct 24 during the operation of the heating system 12, yet the screen openings 52 are sized to be sufficiently small for the purpose of preventing insects from entering the opening in the inlet duct 24 via the screen openings 52.

When the vehicle is traveling, air tends to be moved through the screen openings 52 and the side screen surface 50 thereby cleaning at least some of the particles which may be lodged in the screen openings 52 while the recreational vehicle is traveling. In addition, the raised screen 34 formed by the side screen surface 50 permits rain to wash particles from the screen openings 52.

A second screen **34*a* is positioned over the opening in the outlet duct 26 and connected to the cross-bar 32 or to the side 12 of the recreational vehicle in a manner like that described before with respect to the screen 34 positioned over the inlet duct 24. The screen 34*a* functions in a manner like that described before with respect to the screen 34**.

In the assembled position of the screens 34 and **34*a*, the outward ends 48 and 48*a* of the screens 34 and 34*a* each lie in a plane generally parallel with the planar disposition of the side 12** of the recreational vehicle.

Figure 7:
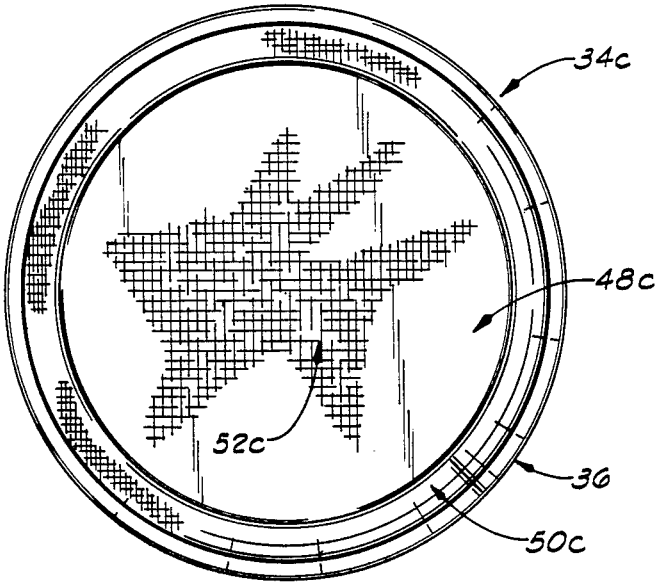
FIG. 7 is a top elevational view of a modified screen constructed in accordance with the present invention.
Figure 8:
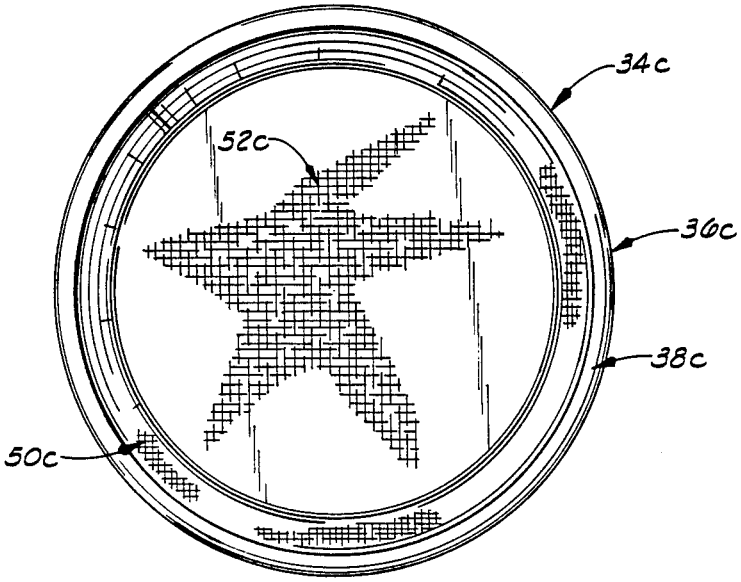
FIG. 8 is a bottom elevational view of the screen of FIG. 7.
Figure 9:
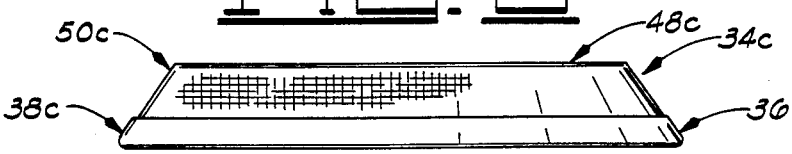
FIG. 9 is a typical side elevational view of the screen of FIGS. 7 and 8.

Shown in FIGS. 7, 8 and 9 is a modified screen **34*c* which is constructed exactly like the screen 34 described in detail before, except the screen 34*c* is circularly shaped as opposed to the rectangularly shaped screen 34. The screen 34*c* will operate and function in a manner exactly like that described before with respect to the screens 34 and 34*a***.

Heating units must operate as though virtually nothing obstructs the air flow through the inlet and outlet ducts. A screen constructed in accordance with the present invention provides little resistance to air flow through the inlet and outlet ducts. Further, the screen of the present invention is attractive in appearance and can be easily installed. Most importantly, the screen of the present invention virtually eliminates problems previously encountered by insects entering the heating unit by way of the inlet or outlet ducts. In addition, the screen of the present invention has a self cleaning feature by virtue of the fact that the screen extends a distance outward from the side of the recreational vehicle.

Figure 1A:
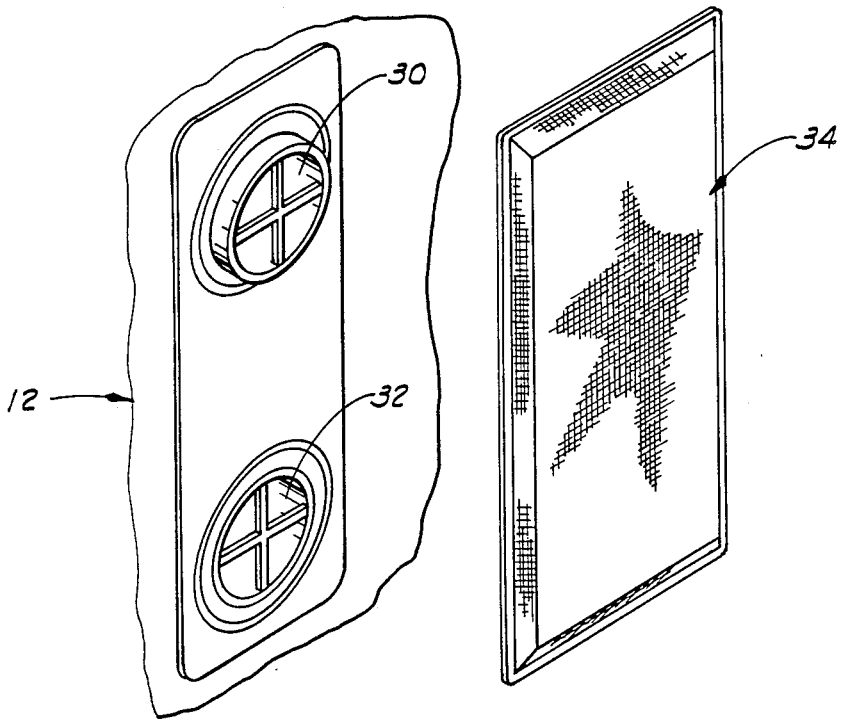
Figure 2:
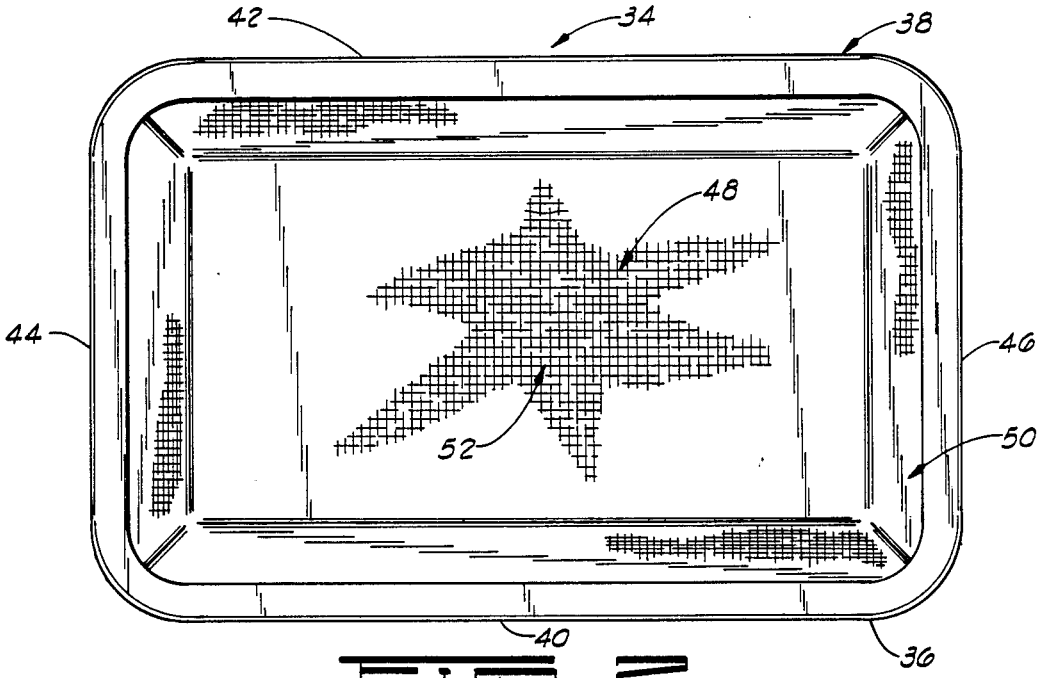
FIG. 2 is a top elevational view of a screen constructed in accordance with the present invention.
Figure 3:
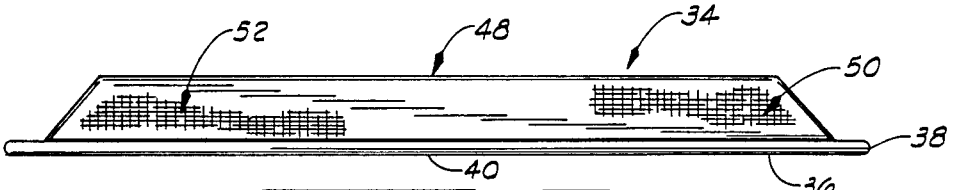
FIG. 3 is a front side elevational view of the screen of FIG. 1.
Figure 4:
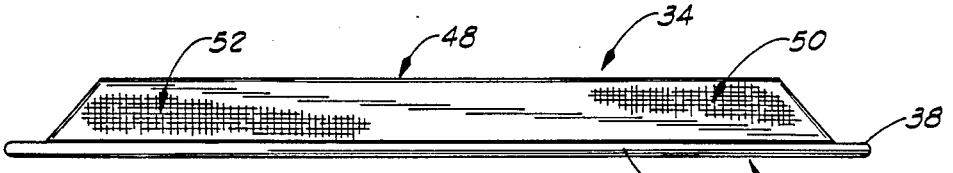
FIG. 4 is a rear side elevational view of the screen of FIGS. 2 and 3.
Figure 5:
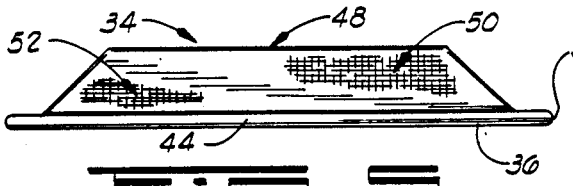
FIG. 5 is a left end elevational view of the screen of FIG. 2.
Figure 6:
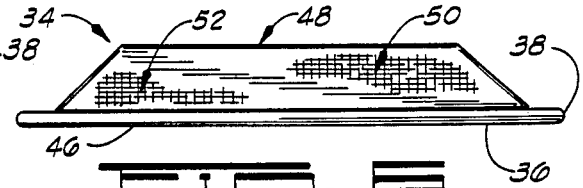
FIG. 6 is a right end elevational view of the screen of FIG. 2.

In one embodiment, as shown in FIG. 1A, the screen 34 is sized to be large enough to extend over the inlet and the outlet ducts 24 and 26, so only one screen 34 is required to cover both ducts 24 and 26. The circularly shaped screen shown in FIGS. 7, 8 and 9 is particularly useful when one screen is used to cover the inlet duct 24 and a second screen 34 is used to cover the outlet duct 26, while the rectangularly shaped screen 34 is particularly useful for simultaneously covering both the inlet and outlet ducts 24 and 26.

Changes may be made in the construction and the operation of the various components, elements and assemblies described herein without departing from the spirit and scope of the invention as defined in the following claims.

What is claimed is:

1. An improvement in a recreational vehicle having a side and a heating system with a heating unit containing burners and a fan and with an inlet duct having an opening extending therethrough, the inlet duct extending from the heating unit and through the side of the recreational vehicle, and with an outlet duct having an opening extending therethrough, the outlet air duct extending from the heating unit and through the side of the recreational vehicle, the improvement comprising:

a screen having a base defining an outer peripheral surface and being connectable to the side of the recreational vehicle whereby the screen substantially encompasses the entire opening in the inlet duct at the end of the inlet duct which extends through the side of the recreational vehicle, the screen having a plurality of screen openings formed therethrough sized and spaced whereby a sufficient percentage of the screen total surface area remains open via the screen openings to permit sufficient air flow through the screen openings and into the opening in the inlet duct for operating the heating unit while the screen openings are sufficiently small to block and prevent a substantial portions of insects from entering the inlet duct, the screen extending a distance outwardly from about the outer peripheral surface and terminating with an outward end thereby forming a side screen surface extending generally about the outer periphery of the screen whereby the screen extends a distance outwardly from the side of the recreational vehicle, each of the screen openings being about square with each of the sides being in a range from about 1/8 inch to about 3/16 inch; and wherein the screen is four sided and wherein the side screen surface extends over the four sides and wherein the outward end is substantially about flat and generally lies within a plane about parallel to the plane of the side of the recreational vehicle or wherein the screen is generally circularly shaped and wherein the outward end is substantially about flat and generally lies within a plane about parallel to the plane of the side of the recreational vehicle.

2. The improvement of claim 1 wherein the screen openings are sized and positioned so that the entire surface area of the screen is less than about 40% closed.

3. The improvement of claim 1 further comprising:

a second screen having a base defining an outer peripheral surface and being connectable to the side of the recreational vehicle whereby the screen substantially encompasses the entire opening in the outlet duct at the end of the outlet duct which extends through the side of the recreational vehicle, the screen having a plurality of screen openings formed therethrough sized and spaced whereby a sufficient percentage of the screen total surface area remains open via the screen openings to permit sufficient air flow through the screen openings and into the opening in the outlet duct for operating the heating unit while the screen openings are sufficiently small to block and prevent a substantial portions of insects from entering the outlet duct, the screen extending a distance upwardly from about the outer peripheral surface and terminating with an outward end thereby forming a side screen surface extending generally about the outer periphery of the screen whereby the screen extends a distance outwardly from the side of the recreational vehicle; the screen openings being about square with each of the sides being in a range from about 1/8 inch to about 3/16 inch; and wherein the second screen is four sided and wherein the side second screen surface extends over the four sides and wherein the outward end is substantially about flat and generally lies within a plane about parallel to the plane of the side of the recreational vehicle, or wherein the second screen is generally circularly shaped and wherein the outward end is substantially about flat and generally lies within a plane about parallel to the plane of the side of the recreational vehicle.

4. The improvement of claim 3 wherein the second screen openings are sized and positioned so that the entire surface area of the second screen is less than about 40% closed.

5. The improvement of claim 1 wherein the screen is sized to substantially encompass the entire opening in the outlet duct at the end of the outlet duct which extends through the side of the recreational vehicle.

6. An improvement in a recreational vehicle having a side and a heating system with a heating unit containing burners and a fan and with an outlet duct having an opening extending therethrough and the outlet duct extending from the heating unit and through the side of the recreational vehicle and with an outlet duct having an opening extending therethrough, the outlet duct extending from the heating unit and through the side of the vehicle, the improvement comprising:

a screen having a base defining an outer peripheral surface and being connectable to the side of the recreational vehicle whereby the screen substantially encompasses the entire opening in the outlet duct at the end of the outlet duct which extends through the side of the recreational vehicle, the screen having a plurality of screen openings formed therethrough sized and spaced whereby a sufficient percentage of the screen total surface area remains open via the screen openings to permit sufficient air flow through the screen openings and into the opening in the outlet duct while the screen openings are sufficiently small to block and prevent a substantial portions of insects from entering the outlet duct, the screen extending a distance upwardly from about the outer peripheral surface and terminating with an outward end thereby forming a side screen surface extending generally about the outer periphery of the screen whereby the screen extends a distance outwardly from the side of the recreational vehicle; each of the screen openings being about square with each of the sides being in a range from about 1/8 inch to about 3/16 inch; and wherein the screen is four sided and wherein the side screen surface extends over the four sides and wherein the outward end is substantially about flat and generally lies within a plane about parallel to the plane of the side of the recreational vehicle, or wherein the screen is generally circularly shaped and wherein the outward end is substantially about flat and generally lies within a plane about parallel to the plane of the side of the recreational vehicle.

7. The improvement of claim 6 wherein the screen openings are sized and positioned so that the entire surface area of the screen is less than about 40% closed.

* * * * *